US011939101B2

(12) United States Patent
Salvá Transfiguración

(10) Patent No.: US 11,939,101 B2
(45) Date of Patent: Mar. 26, 2024

(54) DEVICE FOR EMPTYING FLEXIBLE BAGS CONTAINING FLUIDS

(71) Applicant: LiquidPack, S.L., Castellón (ES)

(72) Inventor: Vicente Luis Salvá Transfiguración, Onda (ES)

(73) Assignee: LiquidPack, S.L., Onda (ES)

( * ) Notice: Subject to any disclaimer, the term of this patent is extended or adjusted under 35 U.S.C. 154(b) by 125 days.

(21) Appl. No.: 17/433,735

(22) PCT Filed: Feb. 19, 2020

(86) PCT No.: PCT/ES2020/070118
§ 371 (c)(1),
(2) Date: Aug. 25, 2021

(87) PCT Pub. No.: WO2020/174106
PCT Pub. Date: Sep. 3, 2020

(65) Prior Publication Data

US 2022/0144474 A1 May 12, 2022

(30) Foreign Application Priority Data

Feb. 26, 2019 (ES) ..... ES201930168

(51) Int. Cl.
*B65B 69/00* (2006.01)

(52) U.S. Cl.
CPC ..... *B65B 69/005* (2013.01); *B65B 69/0008* (2013.01)

(58) Field of Classification Search
CPC ..... B65B 69/005; B65B 69/0008; B65B 69/0075
See application file for complete search history.

(56) References Cited

U.S. PATENT DOCUMENTS 5,765,723 A * 6/1998 Wilcox ..... B65D 77/06 222/100
6,036,408 A * 3/2000 Wilhelm ..... B65G 65/36 406/134
2004/0074922 A1* 4/2004 Bothor ..... B65B 69/0075 222/105

(Continued)

FOREIGN PATENT DOCUMENTS

| | | |
|---|---|---|
| CN | 107697486 | 2/2018 |
| ES | 2717378 | 6/2019 |
| WO | WO 2020/174106 | 9/2020 |

OTHER PUBLICATIONS

International Preliminary Report on Patentability dated Nov. 20, 2020 From the International Preliminary Examining Authority Re. Application No. PCT/ES2020/070118. (15 Pages).

(Continued)

*Primary Examiner* — Andrew M Tecco
*Assistant Examiner* — Nicholas E Igbokwe

(57) ABSTRACT

Device for emptying flexible bags containing fluids, comprising traction means and draining means, the draining means being physically connected to the traction means by means of positioning means such that they are rotatably movable around the traction means and the traction means and the draining means being arranged and mutually enabled to stretch a flexible bag from the traction means and simultaneously to pass and circulate the bag through the draining means.

25 Claims, 10 Drawing Sheets

(56) References Cited

U.S. PATENT DOCUMENTS

| | | | | |
|---|---|---|---|---|
| 2007/0080167 | A1* | 4/2007 | Baker | B65B 69/005 222/102 |
| 2007/0095217 | A1* | 5/2007 | Russo | B65B 69/0075 100/155 R |
| 2011/0095046 | A1 | 4/2011 | Baker et al. | |
| 2015/0167889 | A1* | 6/2015 | Stremlau | F16M 11/045 29/428 |
| 2017/0096293 | A1* | 4/2017 | Sullinger | B65D 88/54 |

OTHER PUBLICATIONS

International Search Report and the Written Opinion dated Jul. 13, 2020 From the International Searching Authority Re. Application No. PCT/ES2020/070118. (15 Pages).

* cited by examiner

DEVICE FOR EMPTYING FLEXIBLE BAGS CONTAINING FLUIDS

RELATED APPLICATIONS

This application is a National Phase of PCT Patent Application No. PCT/ES2020/070118 having International filing date of Feb. 19, 2020, which claims the benefit of priority of Spain Patent Application No. P201930168 filed on Feb. 26, 2019. The contents of the above applications are all incorporated by reference as if fully set forth herein in their entirety.

FIELD AND BACKGROUND OF THE INVENTION

The object of the present patent application is to provide a device for emptying flexible bags containing fluids which incorporates notable innovations and advantages over the techniques used hitherto.

More specifically, the invention proposes the development of a device for emptying flexible bags containing fluids, which, due to its particular arrangement, allows the outlet of the fluid trapped between the folds of the flexible material of the bag and the same fluid to be carried towards the outlet of the bag, in a simple, quick and effective manner.

Nowadays flexible packages or bags for fluid products called bag in box are known.

These types of bags normally house fluid products of various natures, such as cosmetics, foodstuffs, pharmaceuticals, amongst many others.

It is for this reason that due to the different properties that each one of these fluid products has, it is sometimes complicated to empty the contents of its bags satisfactorily in order to use the entire amount of product since, in some cases, disposing of a quantity which could be considered a minimum amount of product can mean a substantial economic loss, all due to the elevated cost/kg to which these products may rise.

As a result, for years, a multitude of systems have been provided to satisfactorily empty these types of bags, attempting to minimize the amount of product that is disposed of due to not being satisfactorily emptied from the interior of the flexible bag made of polymer material preferably.

There are many systems that produce the favorable discharge of these types of fluid products which have different elements that interact with the container bag to cause the emptying of its contents towards the discharge mouth that they usually have.

There are some systems that are especially complex and which incorporate electric, pneumatic or hydraulic operating elements which substantially complicate the entire operation of the system and the costs inherent to its implementation, maintenance and other operations.

The present invention contributes to solving and resolving the present problem as it allows the outlet of the fluid trapped between the folds of the flexible material of a bag and the same fluid to be carried towards the outlet of the bag in a simple, quick and effective manner.

SUMMARY OF THE INVENTION

The present invention has been developed with the aim of providing an emptying device for flexible bags containing fluids which is essentially characterized in that it comprises traction means and draining means, the draining means being physically connected to the traction means by means of positioning means such that they are rotatably moveable around the traction means, and the traction means and the draining means being arranged and mutually enabled for stretching a flexible bag from the traction means and simultaneously passing and circulating the bag through the draining means.

The distance between the traction means and the draining means is preferably variable in the device for emptying flexible bags containing fluids.

Alternatively, in the emptying device for flexible bags containing fluids, the traction means comprise a winch capable of stretching and winding the bags around it with an initial connection in the same winch of the region of the bag opposed to the discharge point of the material packaged in the same bag.

Alternatively, in the device for emptying flexible bags containing fluids, the initial connection between the winch and the bag results from direct contact.

Alternatively, in the device for emptying flexible bags containing fluids, the initial connection between the winch and the bag is carried out by means of a belt capable of winding at one end on the same winch and in turn being tightened so as to join at its other end to said bag.

Alternatively, in the device for emptying flexible bags containing fluids, the draining means comprise a plurality or carousel of rotary rollers arranged and mutually enabled for tightly passing and circulating the bag between them.

Alternatively, in the device for emptying flexible bags containing fluids, the positioning means comprise at least one bar of a telescopic nature, connected by means of at least one joint at one of its ends to the winch and connected at its other end to the plurality or carousel of rollers.

Alternatively, in the device for emptying flexible bags containing fluids, the positioning means comprise arms arranged in the manner of a Y which join in a telescopic section, the arms being connected by means of joints at one of their ends to the winch and the telescopic section connected to the plurality or carousel of rollers.

Preferably, in the device for emptying flexible bags containing fluids, the winch is connected to a container, the bag initially being arranged in the interior of said container, and the container has a mouth connectable to the opening of the bag and which is arranged in the same container, connecting its interior to the exterior.

Preferably, in the device for emptying flexible bags containing fluids, the traction means are actuated by a motor.

Additionally, the device for emptying flexible bags containing fluids comprises a limit sensor connected to the motor and capable of detecting the arrival to a vertical position of the bar and capable of stopping the motor.

Alternatively, the device for emptying flexible bags containing fluids comprises a limit sensor connected to the motor and capable of detecting the arrival to a vertical position of the arms and capable of stopping the motor.

Alternatively, in the device for emptying flexible bags containing fluids, the traction means are manually actuated.

Alternatively, in the device for emptying flexible bags containing fluids, the winch is connected to the container by means of a structure or frame which is fixable in the container itself.

Alternatively, in the device for emptying flexible bags containing fluids, the joints are arranged in the structure.

Alternatively, in the device for emptying flexible bags containing fluids, the structure incorporates horizontal displacement means for displacement along the same ground where the container is located, means for regulating its height in relation to the same ground and means for regulating its horizontal width in relation to the same container, said structure therefore being capable of adapting to different proportions of a container.

Preferably, in the device for emptying flexible bags containing fluids, the height regulating means comprise legs joined to the structure and connected to the ground, said legs having a separation and gap between them suitable for passing or positioning the container between them.

Preferably, in the device for emptying flexible bags containing fluids, the legs are of a telescopic nature.

Additionally, in the device for emptying flexible bags containing fluids, the height regulating means incorporate vertical actuation means.

Preferably, in the device for emptying flexible bags containing fluids, the vertical actuation means comprise at least one pneumatic piston.

Preferably, in the device for emptying flexible bags containing fluids, the horizontal displacement means comprise wheels connected to the lower end of the legs.

Preferably, in the device for emptying flexible bags containing fluids, the horizontal width regulating means comprise crossbeams of a telescopic nature in a horizontal arrangement, simultaneously connected between the legs and between the legs and the structure itself.

Additionally, in the device for emptying flexible bags containing fluids, the legs, the crossbeams and the structure itself configure an assembly of cubic geometry with variable volume and adapted to cover the proportions of a container.

Alternatively, in the device for emptying flexible bags containing fluids, the structure incorporates lateral protection means, enabled to be arranged on the periphery of the container.

Preferably, in the device for emptying flexible bags containing fluids, the lateral protection means comprise at least one flat plate enabled for being positioned vertically on any of the sides of the container.

Additionally, in the device for emptying flexible bags containing fluids, the structure incorporates fixing means, enabled for reversibly securing the structure in one position in the container.

Preferably, in the device for emptying flexible bags containing fluids, the fixing means comprise elements for blocking the wheels, other elements for blocking the extension of the telescopic legs, other elements for blocking the extension of the telescopic crossbeams.

Alternatively, the device for emptying flexible bags containing fluids incorporates control means connected to the vertical actuation means and capable of controlling these.

Preferably, in the device for emptying flexible bags containing fluids, the control means incorporate a dual operating control.

Owing to the present invention, the outlet of the fluid trapped between the folds of the flexible material of a bag is achieved as well as carrying said fluid towards the outlet of the bag in a simple, quick and effective manner.

Other features and advantages of the device for emptying flexible bags containing fluids will be evident from the description of a preferred, but non-exclusive embodiment which is illustrated by way of non-limiting example in the accompanying drawings, in which:

DESCRIPTION OF SPECIFIC EMBODIMENTS OF THE INVENTION

Figure 1:
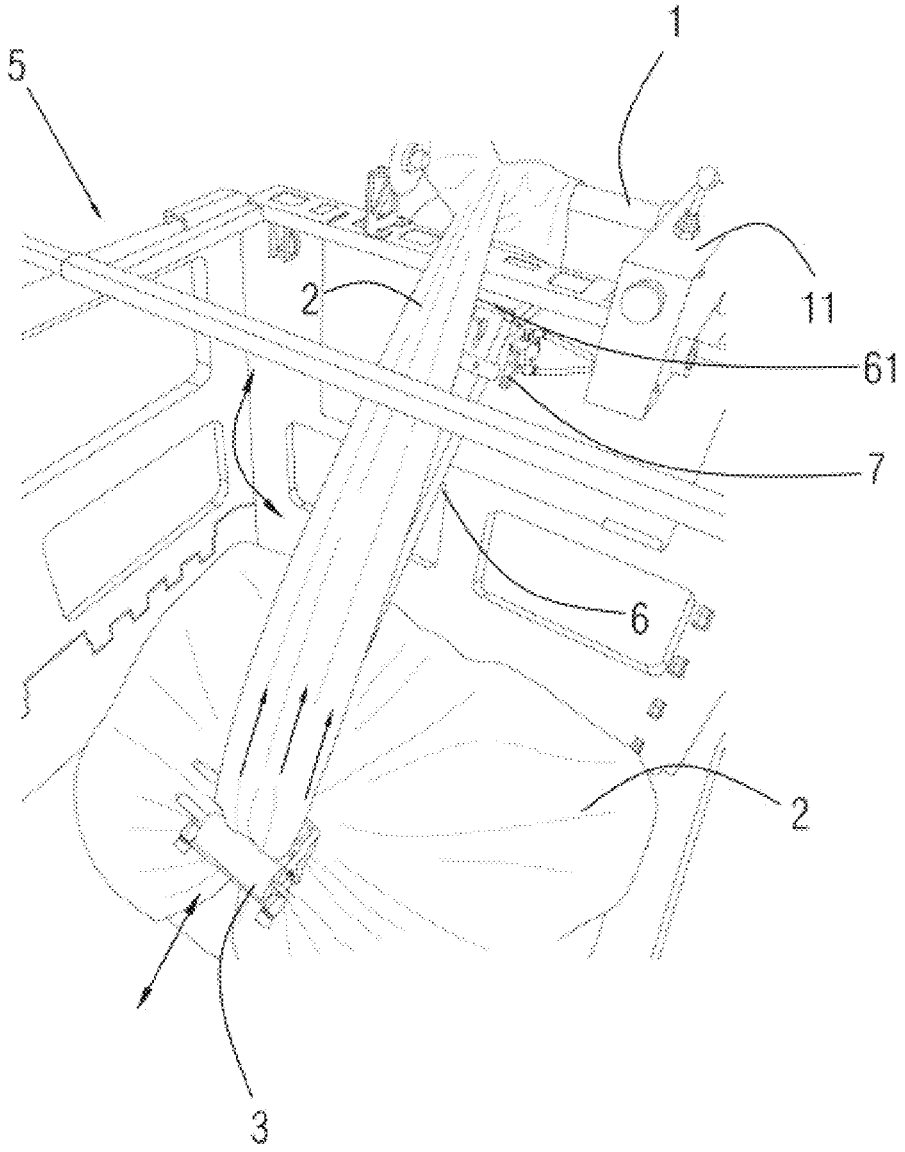
FIGS. 1 and 2 are schematic views from different perspectives of a preferred embodiment of the device for emptying flexible bags containing fluids of the present invention and indicators of its use.
Figure 2:
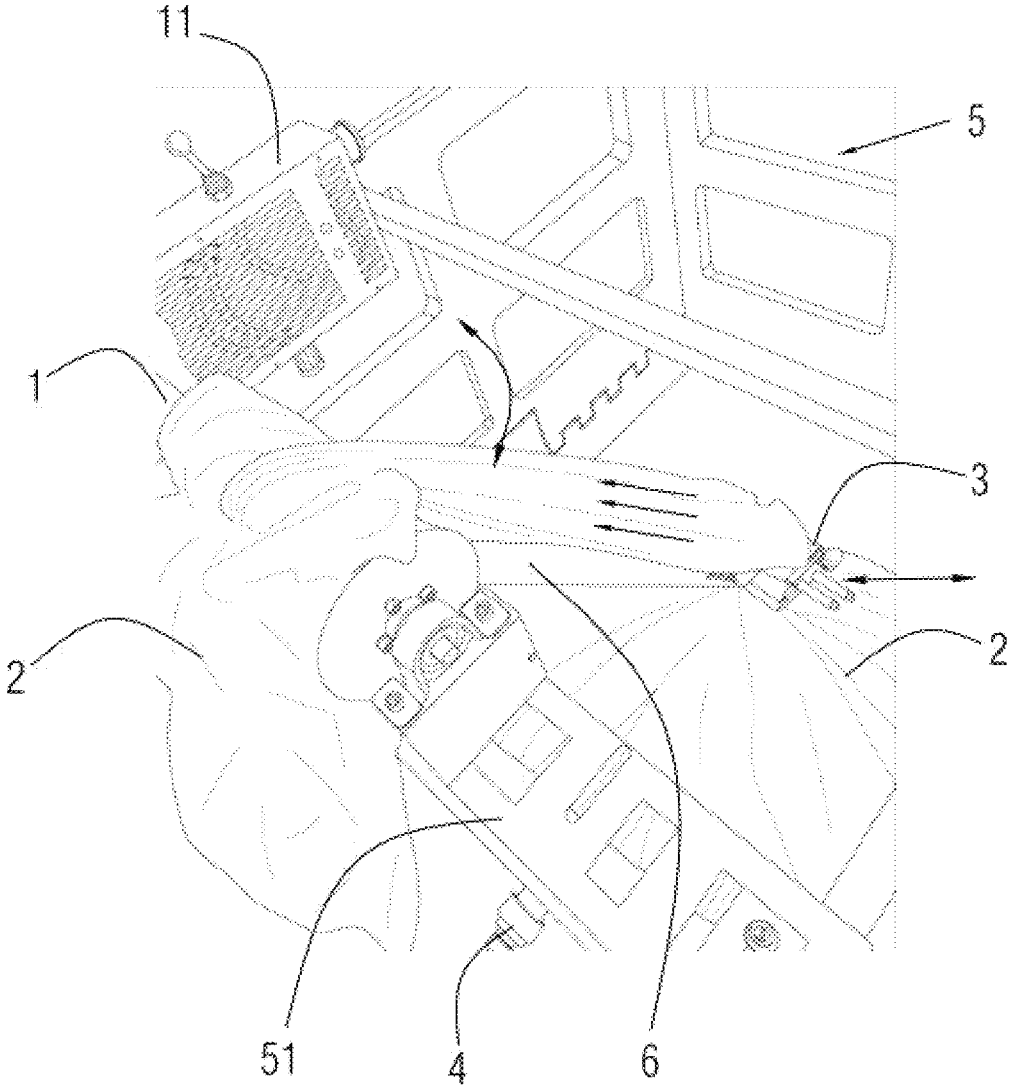

The device for emptying flexible bags containing fluids of the proposed invention comprises traction means and draining means As is shown schematically from different perspectives in one preferred embodiment represented schematically in FIGS. 1 and 2, the traction means comprise a rotary winch 1 capable of stretching and winding a flexible bag 2 around it. Said winch 1 is operated in a motorized manner by means of a motor 11, although in other preferred embodiments, it could even be operated manually.

In addition, in this same preferred embodiment of the same FIGS. 1 and 2, the draining means comprise a plurality of rotary rollers 3 arranged and mutually enabled for tightly passing and circulating the same bag 2 between them.

The winch 1 is connected to a container 5 by means of a structure 51 or frame which is fixed in the container 5 itself, the bag 2 initially being arranged in the interior of said container 5.

Figure 3:
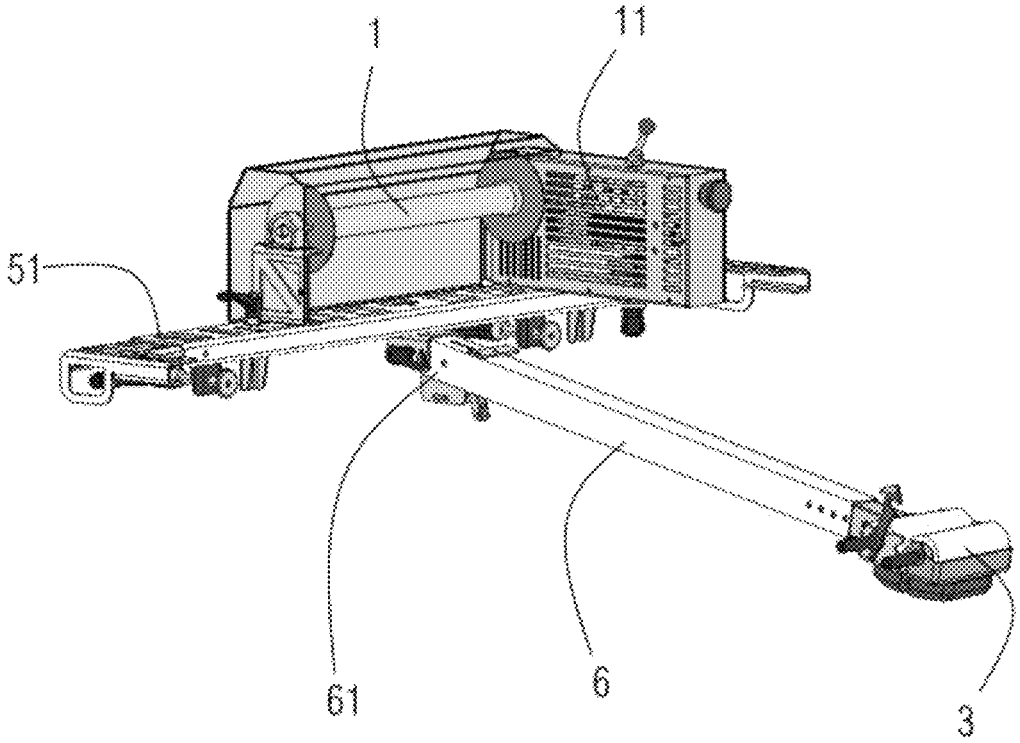
FIG. 3 is a schematic view of the same preferred embodiment of FIGS. 1 and 2 of the device for emptying flexible bags containing fluids of the present invention, but in the absence of the container to help with its appraisal.

In FIG. 3, the same device for empting flexible bags containing fluids of the invention is seen, but in the absence of the container 5 to help with its appraisal.

As can be seen schematically in FIG. 2, the bag 2 must be previously arranged with its opening or point for discharging the packaged material connected to an outlet mouth 4 arranged in the container 5, the other region opposed to the same bag 2 being that which is initially in contact with the winch 1. The outlet mouth 4 connects the interior of the container 5 to its exterior.

The winch 1 in its rotary movement tractions and stretches the bag 2 which is wound around the same winch 1, as can be seen in FIGS. 1 and 2, with an initial contact on the same winch 1 of the region of the bag 2 opposed to the position of the opening of the same bag 2.

At the same time, as the bag 2 is being wound around the winch 1, the same bag 2 is passed and circulated tightly between the rotary rollers 3, as is indicated by the arrows in the same FIGS. 1 and 2 which involves the draining of the bag 2 and the outlet of the fluid being forced from the interior of the bag 2 which is trapped between the folds of the flexible material of the same bag 2, until its outlet through the opening of the same bag 2 towards the outlet mouth 4.

The rollers 3 are physically connected to the winch 1 by means of positioning means such that they are movable in their position with respect to the winch 1, having a rotary movement around the winch 1, as is indicated by the rotary arrows of the FIGS. 1 and 2 and which is simultaneously compatible with the passage and circulation of the bag 2 through the rollers 3. Also, as indicated by the bidirectional arrows of the FIGS. 1 and 2, the distance between the winch 1 and the rollers 3 is variable.

To this end, in this preferred embodiment, the positioning means comprise a bar 6 of a telescopic nature, connected by means of a joint 61 at one of its ends and in the structure 51 to the winch 1, and connected at its other end to the rollers 3. With the rotary movement of the bar 6 around the joint 61, the rotary movement of the rollers 3 is therefore achieved, and the telescopic nature of the same bar 6 allows its radius of rotation and therefore the distance between the rollers 3 and the winch 1 to be varied, and thus to adapt to the different dimensions which the container 5 may present, which container is responsible for supporting the bag 2 which is intended to be emptied conveniently by means of the device for emptying flexible bags containing fluids of the invention.

In addition, as the bag 2 is being wound on the winch 1, the bar 6 by means of the joint 61 tends to be arranged in a vertical position, as there is less section of the bag 2 below the rollers 3. To this end, there is a limit sensor 7 connected to the motor 11, which detects the vertical position of the bar 6 which indicates that the bag 2 is already wound on the winch 1. In this situation, the sensor 7 stops the motor 11. This arrangement allows the operating process of the device for emptying flexible bags containing fluids of the invention to develop automatically without the presence of an operator once the flexible bag 2 is connected to the winch 1.

Figure 4:
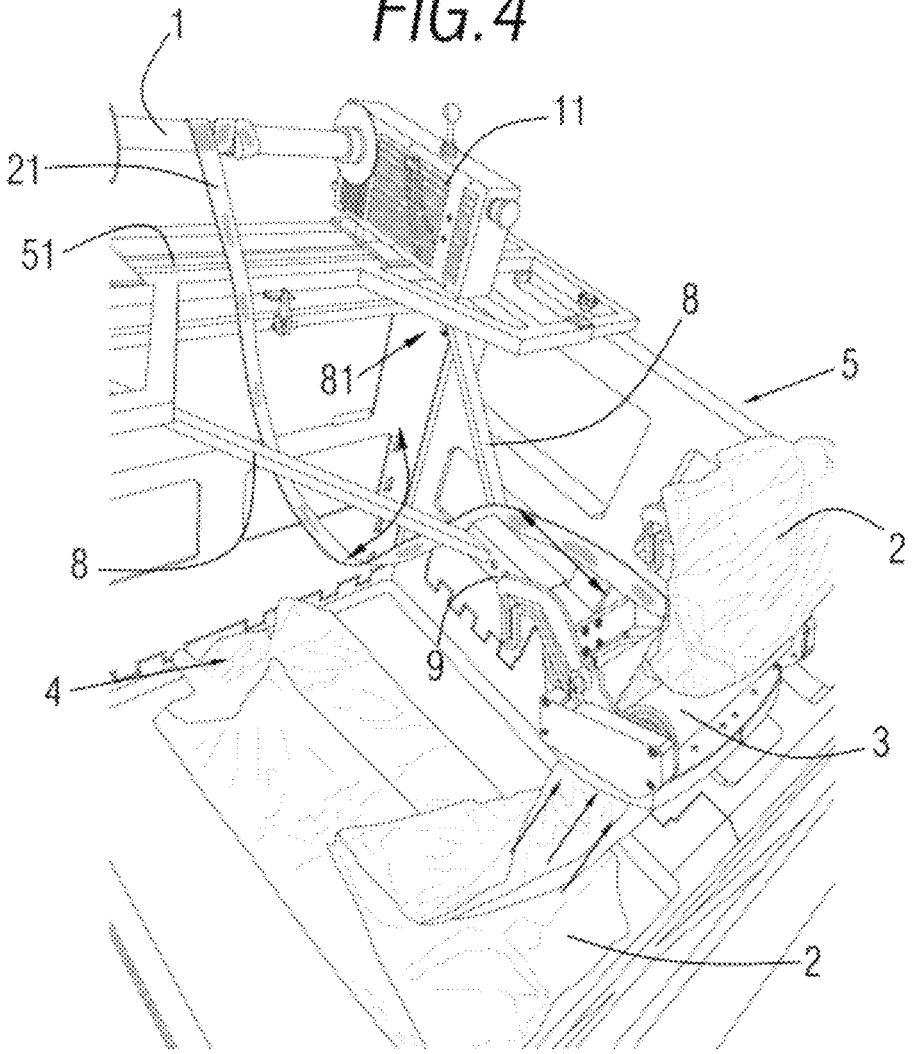
FIGS. 4 and 5 are schematic views from different perspectives of another preferred embodiment of the device for emptying flexible bags containing fluids of the present invention and indicators of its use.
Figure 5:
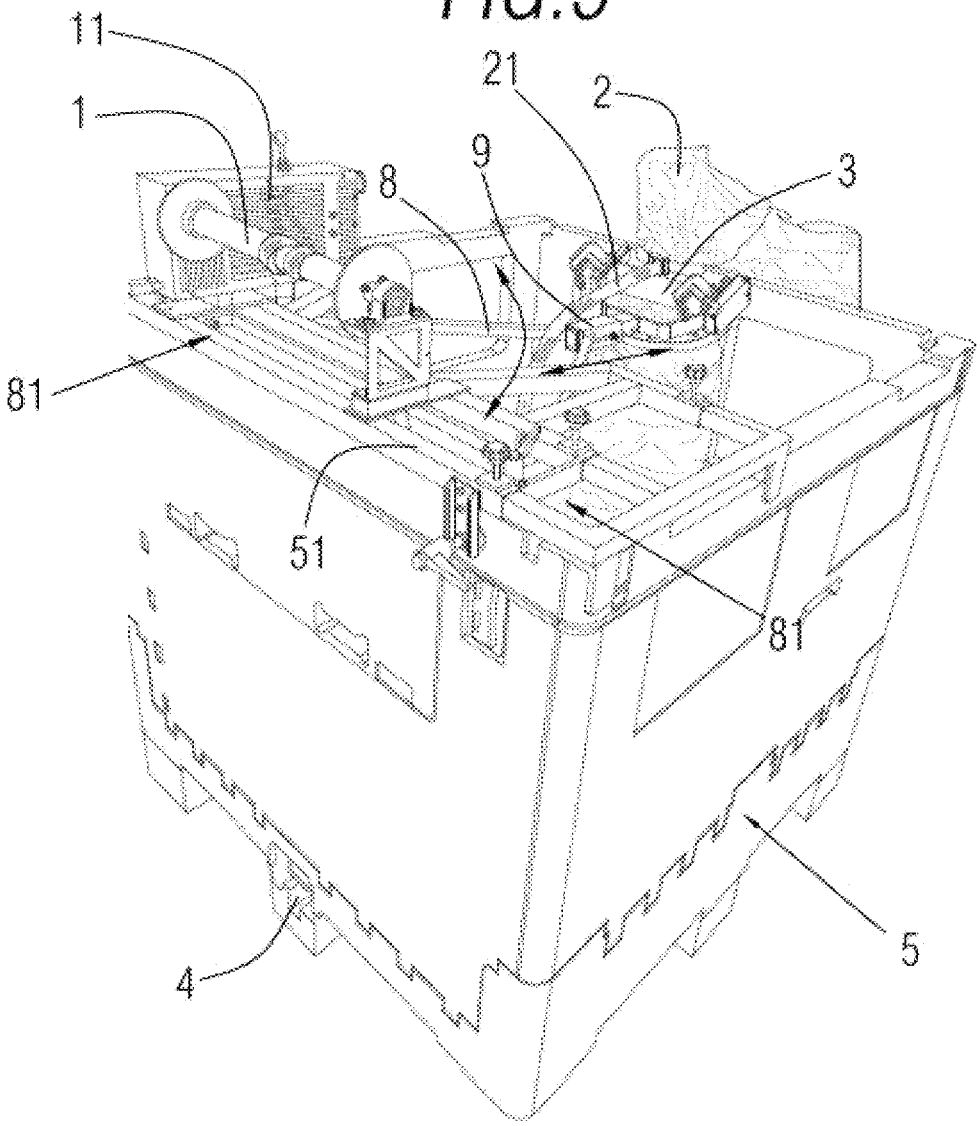

FIGS. 4 and 5 show a schematic representation of another preferred embodiment of the device for emptying flexible bags containing fluids of the proposed invention, arranged and connected likewise on a container 5 and with an operation and advantages very similar to those of the preferred embodiment explained above.

Figure 6:
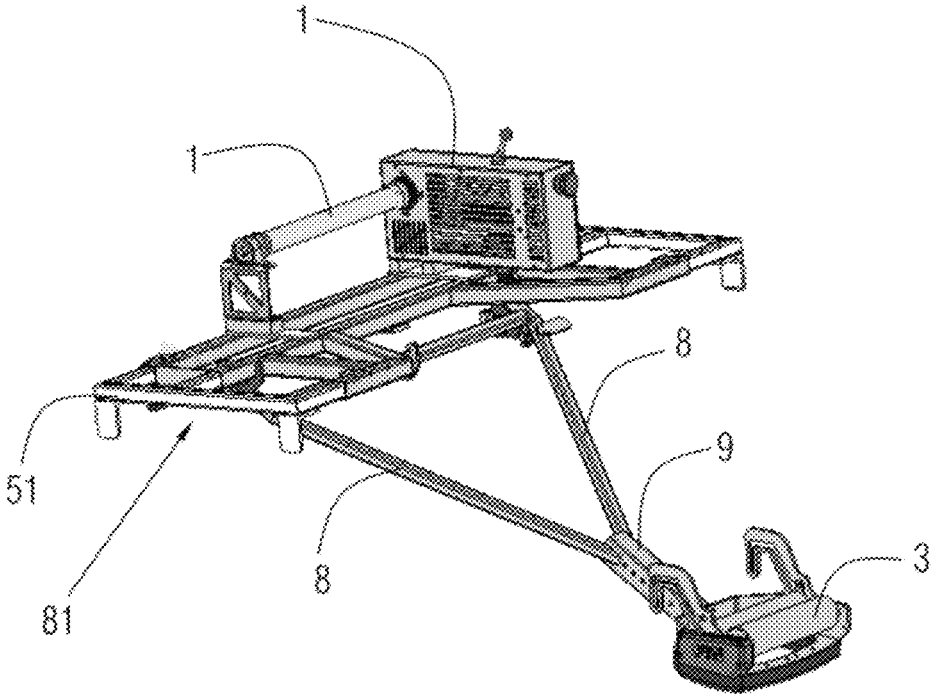
FIG. 6 is a schematic view of the same preferred embodiment of FIGS. 4 and 5 of the device for emptying flexible bags containing fluids of the present invention, but in the absence of the container to help with its appraisal.

In FIG. 6, the same device for emptying flexible bags containing fluids of the invention of FIGS. 4 and 5 is seen, but without the container 5 to help with its appraisal.

In the representation of this preferred embodiment represented in FIGS. 4 and 5, it can be seen with greater clarity how the bag 2 should be previously arranged with its discharge opening or point connected to an outlet mouth 4 arranged in the container 5, the other opposed region of the same bag 2 being that which is initially connected to the winch 1 by means of a belt 21 or band capable of winding at one end on the same winch 1 and in turn tightened so as to join at its other end to said bag 2. Therefore, the traction of the winch 1 is enabled on the bag 2 by means of winding the belt 21 on the same winch 1. The outlet mouth 4 connects the interior of the container 5 to its exterior.

The most substantial difference with respect to the other previous preferred embodiment represented in FIGS. 1, 2 and 3 is the positioning means.

In this preferred embodiment represented in FIGS. 4, 5 and 6, the positioning means comprise arms 8 arranged in the manner of a Y and which also join in a telescopic section 9, the arms 8 being connected by means of joints 81 at one of their ends and on the structure 51 to the winch 1, and the telescopic section 9 connected to the rollers 3. With the rotary movement of the arms 8 around the joints 81, the rotary movement of the rollers 3 is therefore achieved as is indicated by the rotary arrows of FIGS. 4 and 5 and the telescopic capability of the section 9 allows its radius of rotation to be varied and therefore the distance between the rollers 3 and the winch 1 as is indicated by the bidirectional arrows of FIGS. 4 and 5.

This preferred embodiment described in FIGS. 4, 5 and 6 with the arms 8 arranged in the manner of a Y, suitable for example in the case of considerable dimensions of the container 5 or very viscous products in the interior of the bag 2, can present improved features and for example prevent any excessive torsional forces which the other preferred embodiment of FIGS. 1, 2 and 3 with the bar 6 may undergo.

In addition, in the preferred embodiment represented in FIGS. 4 and 5, the connection referenced above between the winch 1 and the bag 2 by means of winding the belt 21 on the same winch 1 involves the bag 2 not having to incorporate an excess of material to be connected or in contact with the same winch 1, thanks to which an optimization and saving of the quantity of material used in the bag 2 is achieved and at the same time an effective traction is also achieved from the winch 1 to the mentioned bag 2.

The device for emptying flexible bags containing fluids of the invention can be adapted to different sizes and volumes of the bag 2 and containers 5.

Owing to the device for emptying flexible bags containing fluids of the proposed invention, the outlet of the fluid trapped between the folds of the flexible material of the bag 2 can be carried out and the same fluid carried to the outlet of the bag 2 in a simple, quick and effective manner and regardless of the geometry of the bottom of the container 5 or recipient housing the flexible bag 2.

In another preferred embodiment of the same device for emptying flexible bags containing fluids of the proposed invention, the referenced structure 51 or frame incorporates horizontal displacement means for displacement along the same ground where the container 5 is located, means for regulating its height in relation to the same ground and means for regulating its horizontal width in relation to the same container 5.

This means that said structure 51 can therefore be adapted to different proportions which a container 5 may have, that is to say, to its height and/or amplitude or width, in addition to facilitating its horizontal transfer to carry out its service on successive containers 5.

Figure 7:
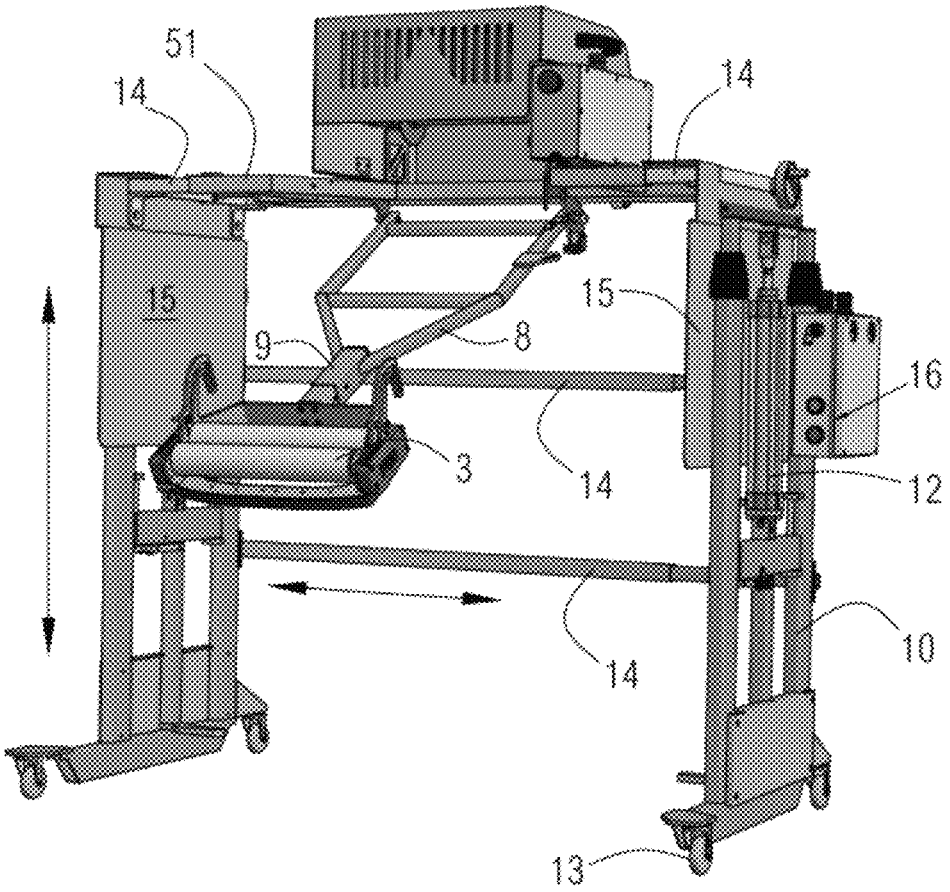
FIGS. 7, 8, 9 and 10 are schematic views from different perspectives of another preferred embodiment of the device for emptying flexible bags containing fluids of the present invention and indicators of its use.
Figure 8:
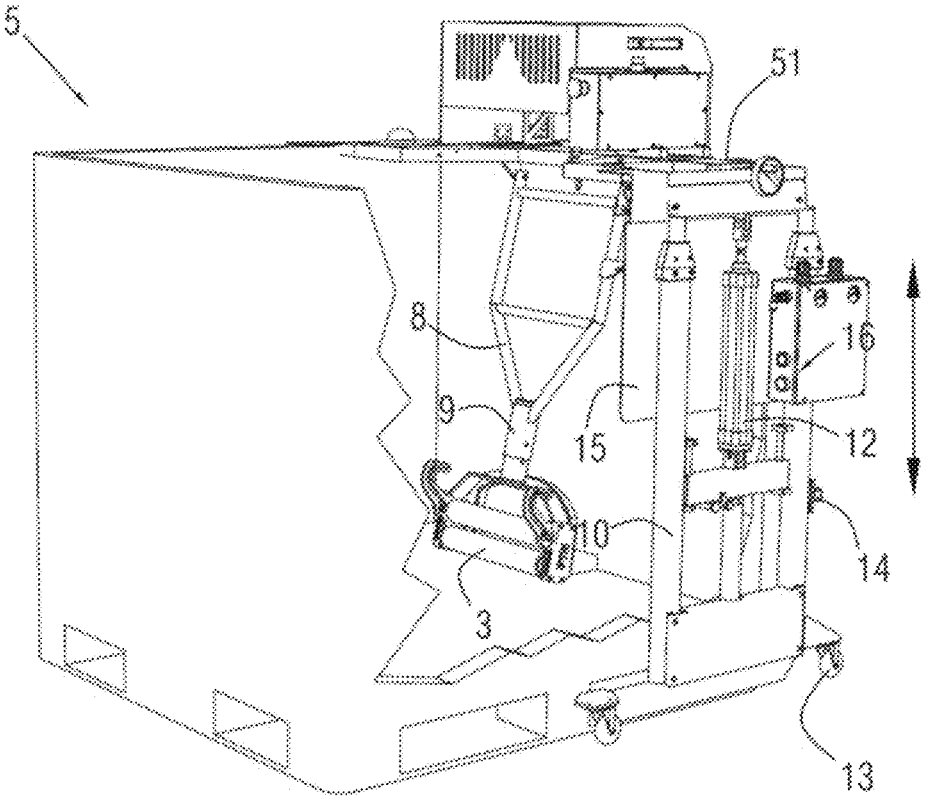

As can be seen schematically in FIGS. 7 and 8, in this represented preferred embodiment, the height regulating means comprise legs 10 joined to the structure 51, said legs 10 also having a separation and gap between them suitable for the passage or positioning of the container 5 between them.

Said legs 10 are of a telescopic nature and the regulation of their useful length allows the structure 51 to have a variable height, as indicated by the arrows of FIGS. 7 and 8, therefore being adapted to different heights of a container 5.

In addition, in order to regulate the useful length of the legs 10, the legs 10 are connected to vertical actuation means which, in this preferred represented embodiment comprise a pneumatic piston 12 which actuates the elevation or descent of the structure 51 as indicated by the vertical arrows of FIGS. 7 and 8.

Figure 9:
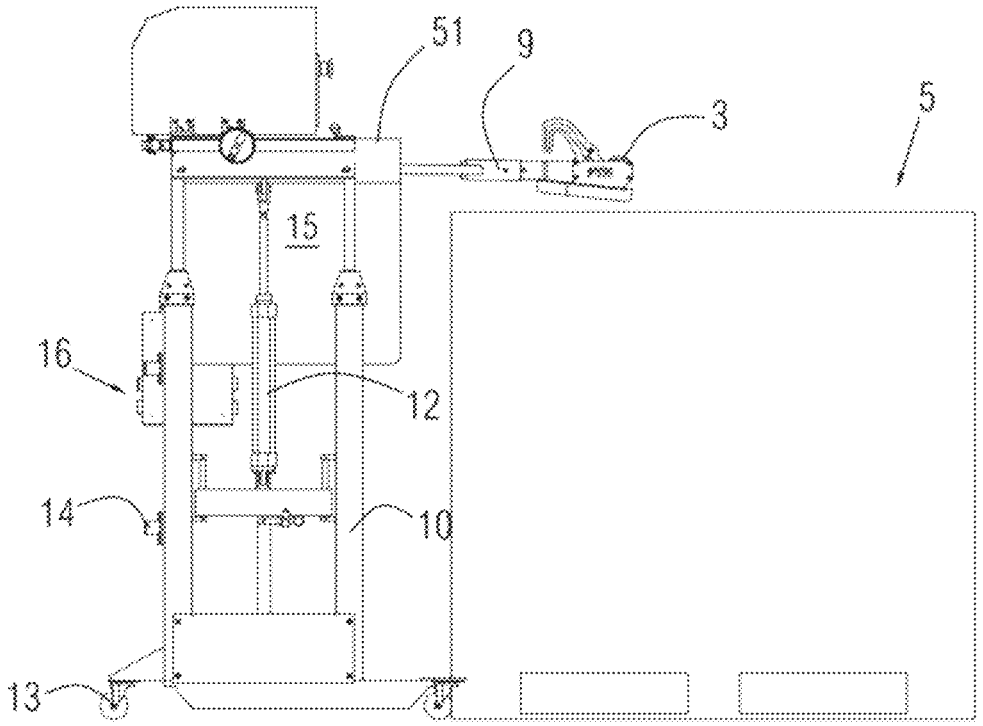
Figure 10:
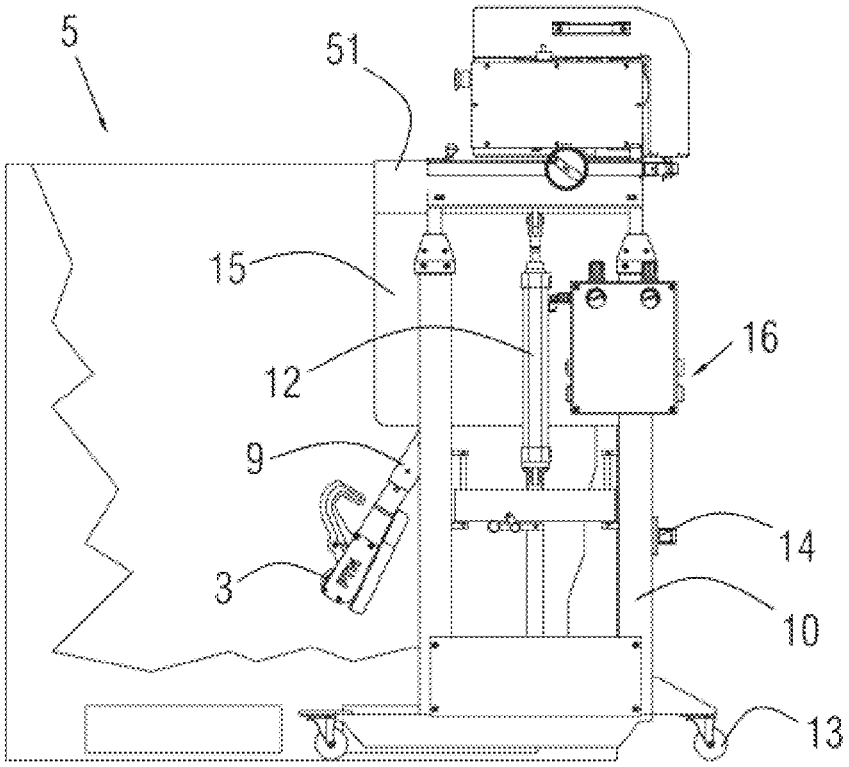

Similarly, as can be seen schematically in FIGS. 7 and 8, the horizontal displacement means comprise wheels 13 connected to the lower end of the legs 10, therefore the structure 51 of the device for emptying flexible bags containing fluids of the invention can be transferred to carry out its service on successive containers 5, as is represented in FIGS. 9 and 10.

In addition, the horizontal width regulating means comprise crossbeams 14 of a telescopic nature and in a horizontal arrangement which are connected to the legs 10 and the structure 51 itself, as can be seen in FIG. 7.

The regulation of the useful length of the crossbeams 14 allows the device for emptying flexible bags containing fluids of the invention to have a variable useful working amplitude or width as indicated by the horizontal arrows of FIG. 7, therefore being adapted to different widths or amplitudes of a container 5.

In accordance with the above, the crossbeams 14 are simultaneously connected to the legs 10 and to the structure 51 itself such that the legs 10, the crossbeams 14 and the structure 51 itself configure an assembly of cubic geometry and variable volume and therefore capable of being adapted to contain any proportions of a container 5, as can be seen especially in FIG. 8, in which the container 5 is sectioned.

In addition, the structure 51 incorporates lateral protection means, enabled to be arranged on the periphery of the container 5. In this preferred embodiment, the lateral protection means comprise flat plates 15 enabled to be positioned vertically on any of the sides of the container 5, as can be seen in FIGS. 7 to 10. Owing to this, it helps to confine the working area and eliminates the risks of any limb of the operator in the operating perimeter of the device for emptying flexible bags containing fluids of the invention becoming trapped.

Similarly, the structure 51 incorporates fixing means, enabled to reversibly secure and retain the structure 51 in one position in the container 5, and therefore to allow the device for emptying flexible bags containing fluid of the invention to function and be removed from the same container 5 after its operation.

In this preferred embodiment, the fixing means comprise elements for blocking or braking the wheels 13, other elements for blocking the extension of the telescopic legs 10 and other elements for blocking the extension of the telescopic crossbeams 14, known in the prior art and not represented in the drawings, in which by means of a simple manual operation, its blocking or release is achieved.

In the preferred embodiment schematically represented in FIGS. 7 to 10, it can also be seen how the device for emptying flexible bags containing fluids incorporates control means connected to the piston 12 and capable of controlling the same. In this preferred embodiment, the control means incorporate a dual operating control 16, positioned on each side, with the aim of requiring a dual security validation of the vertical operation so that the security conditions can be improved and which is necessarily actuated by two operators simultaneously.

Therefore, this preferred embodiment of the device for emptying flexible bags containing fluids of the invention represented in FIGS. 7 to 10 allows suitable adaptation to different proportions which may occur in different containers 5 in a useful, practical, safe and simple manner.

The details, shapes, dimensions and other accessory elements and the materials used in the manufacture of the device for emptying flexible bags containing fluids of the invention can be conveniently substituted for others which are technically equivalent and do not depart from the essence of the invention nor from the scope defined by the claims included below.

The invention claimed is:

1. A device for emptying flexible bags containing fluids, comprising:

traction means and draining means, wherein the draining means being physically connected to the traction means by positioning means such that the traction means and draining means are rotatably movable around the traction means;

wherein the traction means and the draining means being arranged and mutually enabled to stretch a flexible bag (2) from the traction means and simultaneously to pass and circulate the bag (2) through the draining means; and wherein a distance between the traction means and the draining means is variable;

wherein the draining means comprise a plurality or carousel of rotary rollers (3) arranged and mutually enabled to pass and circulate the bag (2) tightly between them;

wherein the traction means comprise a winch (1) capable of stretching and winding the bag (2) around the traction means and wherein the draining means comprise a plurality or carousel of rotary rollers (3) arranged and mutually enabled to pass and circulate the bag (2) tightly between them and wherein the positioning means comprise at least one bar (6) of a telescopic nature, connected by means of at least one joint (61) at one of its ends to the winch (1) and connected at its other end to the plurality or carousel of rollers (3).

2. The device for emptying flexible bags containing fluids according to claim 1, wherein the traction means comprise a winch (1) capable of stretching and winding the bag (2) around the traction means, with an initial connection on the same winch (1) of the region of the bag (2) opposed to the discharge point of the material packaged in the same bag (2).

3. The device for emptying flexible bags containing fluids according to claim 2, wherein the initial connection between the winch (1) and the bag (2) results from direct contact.

4. The device for emptying flexible bags containing fluids according to claim 2, wherein the initial connection between the winch (1) and the bag (2) is carried out by means of a belt (21) capable of winding at one end on the same winch (1) and in turn being tightened so as to join at its other end to said bag (2).

5. The device for emptying flexible bags containing fluids according to claim 1, wherein the traction means comprise a winch (1) capable of stretching and winding the bag (2) around the traction means and wherein the draining means comprise a plurality or carousel of rotary rollers (3) arranged and mutually enabled to pass and circulate the bag (2) tightly between them and wherein the winch (1) is connectable to a container (5), the bag (2) initially being arranged in the interior of said container (5) and in that the container (5) has a mouth (4) connectable to the opening of the bag (2) and which is arranged in the same container (5), communicating its interior with the exterior.

6. The device for emptying flexible bags containing fluids according to claim 5, wherein the winch (1) is connected to the container (5) by means of a structure (51) or frame which is fixable in the container itself (5).

7. The device for emptying flexible bags containing fluids according to claim 6, wherein the structure (51) incorporates horizontal displacement means for displacement along the same ground where the container (5) is located, means for regulating its height in relation to the same ground and means for regulating its horizontal width in relation to the same container (5), so that said structure (51) is capable of adapting to different proportions of a container (5).

8. The device for emptying flexible bags containing fluids according to claim 7, wherein the structure (51) incorporates lateral protection means, configured to be arranged on the periphery of the container (5).

9. The device for emptying flexible bags containing fluids according to claim 8, wherein the lateral protection means comprise at least one flat plate (15) configured to be positioned vertically on any of the sides of the container (5).

10. The device for emptying flexible bags containing fluids according to claim 7, wherein the height regulating means comprise legs (10) joined to the structure (51) and connected to the ground, said legs (10) having a separation and gap between them suitable for passing or positioning the container (5) between them.

11. The device for emptying flexible bags containing fluids according to claim 10, wherein the legs (10) are of a telescopic nature.

12. The device for emptying flexible bags containing fluids according to claim 10, wherein the height regulating means incorporate vertical actuation means.

13. The device for emptying flexible bags containing fluids according to claim 12, wherein the vertical actuation means comprise at least one pneumatic piston (12).

14. The device for emptying flexible bags containing fluids according to claim 10, wherein the horizontal displacement means comprise wheels (13) connected to the lower end of the legs (10).

15. The device for emptying flexible bags containing fluids according to claim 10, wherein the horizontal width regulating means comprise crossbeams (14) of a telescopic nature in a horizontal arrangement, simultaneously connected between the legs (10) and between the legs (10) and the structure (51).

16. The device for emptying flexible bags containing fluids according to claim 15, wherein the legs (10), the crossbeams (14) and the structure itself (51) configure an assembly of cubic geometry with variable volume and adapted to cover the proportions of a container (5).

17. The device for emptying flexible bags containing fluids according to claim 1, wherein the traction means are actuated by a motor (11).

18. The device for emptying flexible bags containing fluids according to claim 17, wherein the positioning means comprise at least one bar (6) and wherein the device comprises a limit sensor (7) connected to the motor (11) and capable of detecting an arrival to a vertical position of the at least one bar (6) and capable of stopping the motor (11).

19. The device for emptying flexible bags containing fluids according to claim 17, wherein the device comprises a limit sensor (7) connected to the motor (11) and capable of detecting an arrival to a vertical position of the arms (8) and capable of stopping the motor (11).

20. The device for emptying flexible bags containing fluids according to claim 1, wherein the traction means are manually actuated.

21. The device for emptying flexible bags containing fluids according to claim 1, wherein the joint (61) is arranged on the structure (51).

22. A device for emptying flexible bags containing fluids, comprising:

traction means and draining means, wherein the draining means being physically connected to the traction means by positioning means such that the traction means and draining means are rotatably movable around the traction means;

wherein the traction means and the draining means being arranged and mutually enabled to stretch a flexible hag (2) from the traction means and simultaneously to pass and circulate the bag (2) through the draining means; and wherein a distance between the traction means and the draining means is variable;

wherein the draining means comprise a plurality or carousel of rotary rollers (3) arranged and mutually enabled to pass and circulate the bag (2) tightly between them;

wherein the draining means comprise a plurality or carousel of rotary rollers (3) arranged and mutually enabled to pass and circulate the bag (2) tightly between them and wherein the positioning means comprise arms (8) arranged in the manner of a Y which join in a telescopic section (9), the arms (8) being connected by means of joints (81) at one of their ends to the winch (1) and the telescopic section (9) being connected to the plurality or carousel of rollers (3).

23. The device for emptying flexible bags containing fluids according to claim 22, wherein the joints (81) are arranged on the structure (51).

24. A device for emptying flexible bags containing fluids, comprising:

traction means and draining means, wherein the draining means being physically connected to the traction means by positioning means such that the traction means and draining means are rotatably movable around the traction means;

wherein the traction means and the draining means being arranged and mutually enabled to stretch a flexible bag (2) from the traction means and simultaneously to pass and circulate the bag (2) through the draining means; and wherein a distance between the traction means and the draining means is variable;

wherein the draining means comprise a plurality or carousel of rotary rollers (3) arranged and mutually enabled to pass and circulate the bag (2) tightly between them; wherein the traction means comprise a winch (1) capable of stretching and winding the bag (2) around the traction means and wherein the draining means comprise a plurality or carousel of rotary rollers (3) arranged and mutually enabled to pass and circulate the bag (2) tightly between them and wherein the winch (1) is connectable to a container (5), the hag (2) initially being arranged in the interior of said container (5) and in that the container (5) has a mouth (4) connectable to the opening of the bag (2) and which is arranged in the same container (5), communicating its interior with the exterior;

wherein the winch (1) is connected to the container (5) by means of a structure (51) or frame which is fixable in the container itself (5);

wherein the structure (51) incorporates horizontal displacement means for displacement along the same ground where the contained (5) is located, means for regulating its height in relation to the same ground and means for regulating its horizontal width in relation to the same container (5), so that said structure (51) is capable of adapting to different proportions of a container (5);

wherein the height regulating means comprise legs (10) joined to the structure (51) and connected to the ground, said legs (10) having a separation and gap between them suitable for passing or positioning the container (5) between them wherein the height regulating means incorporate vertical actuation means;

wherein the device incorporates control means connected to the vertical actuation means and capable of controlling the same.

25. The device for emptying flexible bags containing fluids according to claim 24, wherein the control means incorporate a dual operating control (16).

* * * * *